United States Patent [19]

Griffith

[11] Patent Number: 4,843,201

[45] Date of Patent: Jun. 27, 1989

[54] INDUCTION HEATER COUPLING CONTROL BY CORE SATURATION

[75] Inventor: John T. Griffith, Clwyd, United Kingdom

[73] Assignee: The Electricity Council, London, United Kingdom

[21] Appl. No.: 198,253

[22] Filed: May 17, 1988

[30] Foreign Application Priority Data

Jun. 10, 1987 [GB] United Kingdom ..... 8713539

[51] Int. Cl.[4] ..... H05B 5/00; H05B 6/00; H05B 6/64

[52] U.S. Cl. ..... 219/10.491; 219/10.61 A; 219/10.75; 219/10.77; 219/10.79; 336/73

[58] Field of Search ..... 219/10.491, 10.493, 219/10.51, 10.57, 10.61 R, 10.61 A, 10.75, 10.77, 10.79, 10.65, 10.69; 336/73, 174, 175

[56] References Cited

U.S. PATENT DOCUMENTS 3,107,268 10/1963 Kraus ..... 219/10.65 X
4,256,945 3/1981 Carter et al. ..... 219/10.75
4,265,922 5/1981 Tsuchiya et al. ..... 426/520
4,629,844 12/1986 Griffeth et al. ..... 219/10.491

*Primary Examiner*—A. D. Pellinen
*Assistant Examiner*—David A. Osborn
*Attorney, Agent, or Firm*—Beveridge, DeGrandi & Weilacher

[57] ABSTRACT

An induction heater comprising an alternating-current-carrying conductor (1) extending along an axis; a plurality of core sections (3, 4, 5) arranged in line and each substantially encircling the axis to guide magnetic flux resulting from the alternating current in the conductor (1); a plurality of heating element sections respectively associated with the core sections and each comprising an electrically conductive closed loop encircling magnetic flux in the associated core section (3, 4, 5) and being heated by electrical current induced thereby; and means (13, 14) to at least partially saturate at least one (4, 5) of the core sections thereby to reduce the coupling between the conductor (1) and the heating element section associated with said one core section (4, 5) and thus control the heating effected by said one core section (4, 5) and its associated heating element section (FIG. 4).

5 Claims, 2 Drawing Sheets

FIG. 2.
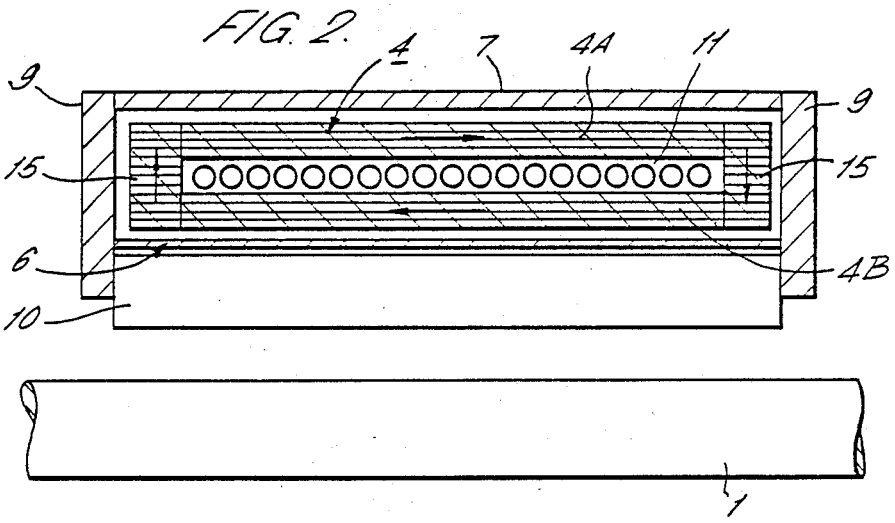
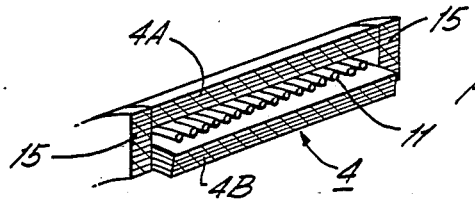
FIG. 3.
FIG. 4.
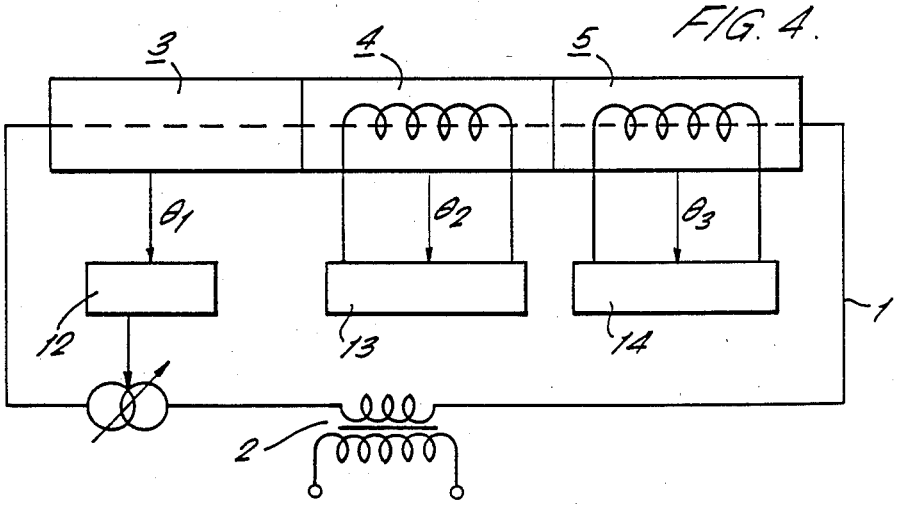

INDUCTION HEATER COUPLING CONTROL BY CORE SATURATION

This invention relates to an induction heater.

In GB-A-2163930 there is described an induction heater having an alternating-current-carrying conductor extending along an axis, a core substantially encircling the axis to guide magnetic flux resulting from the alternating current in the conductor, and a heating element for contacting and transferring heat to material to be heated, the heating element comprising an electrically conductive closed loop encircling magnetic flux in the core and being heated by electrical current induced thereby. In a heater specifically described in the noted publication the core is elongate and encircles a straight length of a conductor loop, the heating element comprising inner and outer cylinders with the core between them, the cylinders being connected together by end plates. Material to be heated is placed inside the inner cylinder which can be provided with inwardly directed longitudinally extending fins which are also heated and which serve to increase the hot surface area for contact with the material to be heated. The alternating current is induced in the loop by means of a toroidal primary transformer located on another branch of the conductor loop.

While such known induction heaters are adequate for many purposes, a difficulty which arises with such heaters is that individual control of the heating effected at different positions or zones along the heater is not possible. Individual heating levels can be obtained by appropriate initial construction of such a heater, but it is not possible to vary the heating in different zones during use of the heater.

According to this invention there is provided an induction heater comprising an alternating-current-carrying conductor extending along an axis; a plurality of core sections arranged in line and each substantially encircling the axis to guide magnetic flux resulting from the alternating current in the conductor; a plurality of heating element sections respectively associated with the core sections and each comprising an electrically conductive closed loop encircling magnetic flux in the associated core section and being heated by electrical current induced thereby; and means to at least partially saturate at least one of the core sections thereby to reduce the coupling between the conductor and the heating element section associated with said one core section and thus control the heating effected by said one core section and its associated heating element section.

With the heater of this invention, by controlling the degree of saturation of the one or more controllable core sections it is possible to control the heating effected at the corresponding positions or zones along the axis of the heater as required.

This invention will now be described by way of example with reference to the drawings, in which:

FIG. 2 is a diagrammatic longitudinal sectional view illustrating the construction of heating element sections of the heater of FIG. 1;

FIG. 3 is a sectional perspective view illustrating the construction of a core section of the heater of FIG. 1; and FIG. 4 is a block electrical circuit diagram of the heater of FIGS. 1 to 3.

Figure 1:
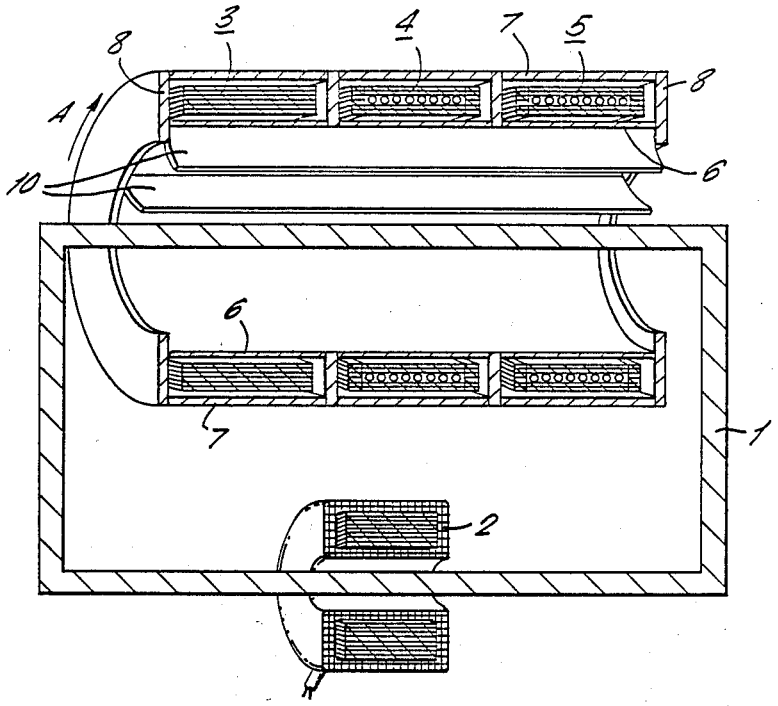
FIG. 1 is a diagrammatic illustration of a bulk material induction heater according to the invention.

Referring to the drawings, the heater comprises an alternating-current-carrying conductor 1 in the form of a loop, the conductor 1 being made of copper and being laminated to reduce the AC resistance. An alternating current is induced in the conductor loop 1 by means of a toroidally wound primary transformer 2 positioned about the conductor 1. Otherwise the current can be injected into the loop from a transformer having a low voltage secondary winding connected in series with the loop. A straight portion of the conductor 1 extends along an axis about which are located three aligned laminated ferromagnetic core sections 3, 4 and 5 each enclosed within an individual metal housing formed by axially aligned inner and outer cylinders 6 and 7 joined by end plates 8 with adjacent housings separated by intermediate plates 9. Each housing forms an electrically conductive closed loop about the associated core section 3, 4 or 5.

Alternating current set up in the conductor 1 by the transformer 2 sets up an alternating magnetic flux which is guided by the core sections 3, 4 and 5 and induces currents to flow around the closed loops constituted by the associated housings, in the direction of the axis of the cylinders 6 and 7, whereby the housings are heated and constitute heating element sections.

Material to be heated is placed in the cylinder constituted by the inner cylinders 6 of the heating element sections. To enhance heat transfer between the inner cylinders 6 of the heating element sections and the material to be heated, each inner cylinder 6 is provided with a plurality of longitudinally extending radially directed fins 10 thereby to increase the heated surface area in contact with the material to be heated.

If required a protective tube (not shown) can be provided about the conductor 1 within the heating cylinder.

The structure comprising the heating element sections formed by the cylinders 6 and 7, and the associated core sections 3, 4 and 5, is rotated about the conductor 1 as indicated by the arrow A in FIG. 1 whereby the material to be heated is moved about within the heating cylinder in order to obtain substantially uniform heat transfer from the heating cylinder 6 and the fins 10 to the material to be heated.

The heating element section constituted by the core section 3 and the associated housing 6, 7 constitutes an uncontrollable section, the heating effected thereby being entirely dependent upon the current flowing in the conductor 1.

However, the heating element sections constituted by the core sections 4 and 5 and their associated housings, constitute controllable sections, and the construction of each thereof will now be described with reference to FIGS. 2 and 3 of the drawings.

As shown in FIGS. 2 and 3, in a controllable section the core section 4 (or 5) is formed of two radially spaced layers 4A and 4B joined by end sections 15, with a control winding 11 arranged in the space between the two core section layers 4A and 4B. When the control winding 11 has a d.c. signal supplied thereto the core section layers 4A and 4B are magnetised axially and can be driven to saturation, thereby reducing the coupling between the current flowing in the conductor 1 and the associated heating element section 6, 7 so reducing the power density in that section.

The heating effected by such a controllable heating element section can thus be controlled, for example in order to give a required temperature profile along the heating cylinder.

FIG. 4 shows a control arrangement for the heater of FIGS. 1 to 3. A mains controller 13 functions as a constant current source and serves to maintain a constant current in the conductor 1 regardless of the changing load due to saturation of the core sections 4 and 5, this constant current providing constant heating by the heating element section containing the core section 3.

The core sections 4 and 5 have individual d.c. control signal sources 13 and 14 respectively which provide d.c. signals controlling the saturation of the core sections 4 and 5 therby to control the heating effected by the associated heating element sections.

Although the heater described above has one uncontrolled and two controlled sections, it will be appreciated that heaters having any number or arrangement of uncontrolled and controlled sections can be provided as necessary for required heating operations.

Further, although the heater described above is a bulk heater, it will be appreciated that heaters in accordance with the invention can otherwise be of continuous flow type, for example as described in GB-A-2163930.

I claim:

1. An induction heater comprising an alternating-current-carrying conductor extending along an axis; a plurality of core sections arranged in line and each substantially encircling the axis to guide magnetic flux resulting from the alternating current in the conductor; a plurality of heating element sections respectively associated with the core sections and each comprising an electrically conductive closed loop encircling magnetic flux in the associated core section and being heated by electrical current induced thereby; and means to at least partially saturate at least one of the core sections thereby to reduce the coupling between the conductor and the heating element section associated with said one core section and thus control the heating effected by said one core section and its associated heating element section.

2. A heater as claimed in claim 1, in which each heating element section comprises coaxial inner and outer cylinders joined by end plates, the associated core section being located between the inner and outer cylinders.

3. A heater as claimed in claim 1, in which said one core section is formed of two radially spaced layers joined by end sections, and having a control winding located in the space between the layers, and including means to supply an individual d.c. control signal to the control winding.

4. A heater as claimed in claim 1, including means to supply a constant alternating current to the conductor.

5. A heater as claimed in claim 1, in which each heating element section has a plurality of longitudinally extending inwardly directed fins thereon.

* * * * *